US005370090A

United States Patent [19]

Murata et al.

[11] Patent Number: 5,370,090

[45] Date of Patent: Dec. 6, 1994

[54] MULTI-CYLINDER INTERNAL COMBUSTION ENGINE

[75] Inventors: Shinichi Murata; Hirofumi Higashi, both of Kyoto, Japan

[73] Assignee: Mitsubishi Jidosha Kogyo Kabushiki Kaisha, Tokyo, Japan

[21] Appl. No.: 29,044

[22] Filed: Mar. 10, 1993

[30] Foreign Application Priority Data

Mar. 11, 1992 [JP] Japan ..... 4-12002[U]
Mar. 24, 1992 [JP] Japan ..... 4-15303[U]

[51] Int. Cl.[5] ..... F01L 1/34
[52] U.S. Cl. ..... 123/90.16; 123/90.38
[58] Field of Search ..... 123/90.15, 90.16, 90.27, 123/90.33, 90.36, 90.38

[56] References Cited

U.S. PATENT DOCUMENTS

| | | | |
|---|---|---|---|
| 4,535,732 | 8/1985 | Nakano et al. | 123/90.16 |
| 4,537,165 | 8/1985 | Honda et al. | 123/90.16 |
| 4,589,387 | 5/1986 | Miura et al. | 123/90.16 |
| 4,854,273 | 8/1989 | Uesugi et al. | 123/90.16 |
| 4,883,027 | 11/1989 | Okawa et al. | 123/90.16 |
| 4,957,077 | 9/1990 | Okitsu et al. | 123/90.27 |
| 5,150,675 | 9/1992 | Murata | 123/90.38 |
| 5,186,128 | 2/1993 | Murata et al. | 123/90.16 |

FOREIGN PATENT DOCUMENTS

| | | |
|---|---|---|
| 2566837 | 1/1986 | France . |
| 4122827 | 1/1992 | Germany . |
| 213604 | 9/1991 | Japan . |
| 0195729 | 9/1938 | Switzerland . |

OTHER PUBLICATIONS

Patent Abstracts of Japan, vol. 15, No. 151 (M-1103) 16 Apr. 1989 & JP-A-30 26 815 (Yamaha Motor Co., Ltd.) 5 Feb. 1991 *Valve Timing Control Device of Dohc Engine.*

Patent Abstracts of Japan, vol. 9, No. 294 (M-431) 20 Nov. 1985 & JP-A-60 132 011 (Honda Giken Kogyo KK) 13 Jul. 1985; *Valve Operation Stopping Device of Internal Combustion Engine.*

*Primary Examiner*—E. Rollins Cross
*Assistant Examiner*—Weilun Lo

[57] ABSTRACT

In a valve-moving apparatus for a V-type multi-cylinder internal combustion engine in which plural rows of cylinders are disposed at predetermined angle relative to a crank shaft, cam shafts having cams disposed offset according to the plural rows of individual cylinders are provided, and fluid supply means provided on the cylinder head for supplying hydraulic pressure to a cooling passage, a lubricating passage, or change-over means of the valve-moving mechanism of variable valve operation condition is disposed in a space formed between the cylinder rows or in a space formed by cam shafts disposed offset along the crank shaft axial direction.

8 Claims, 19 Drawing Sheets

FIG. 11 (a)
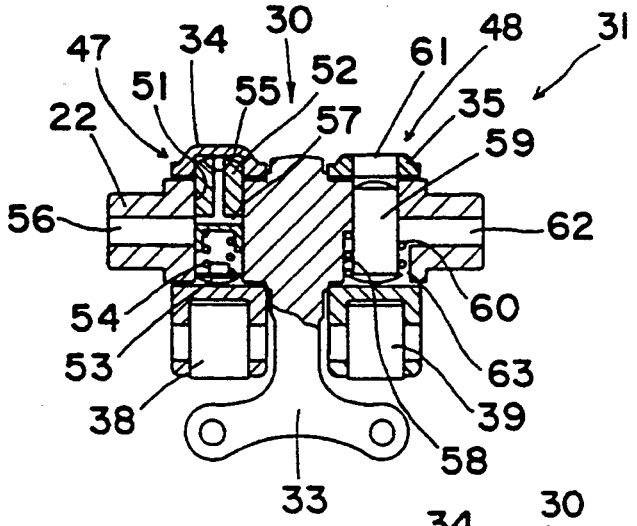
FIG. 11 (b)
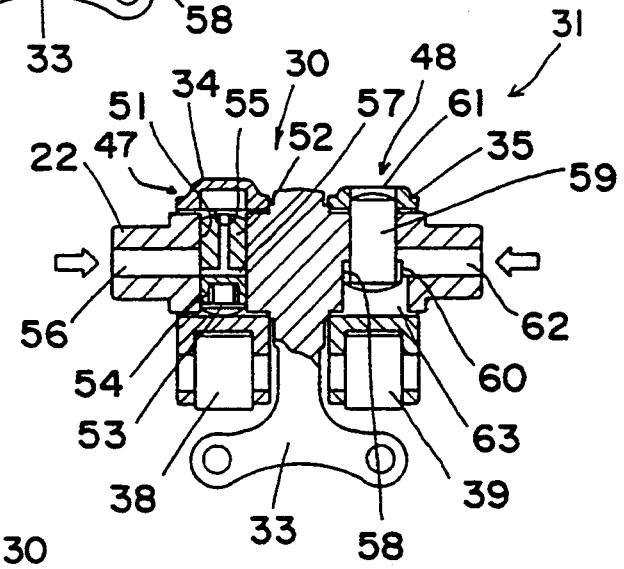
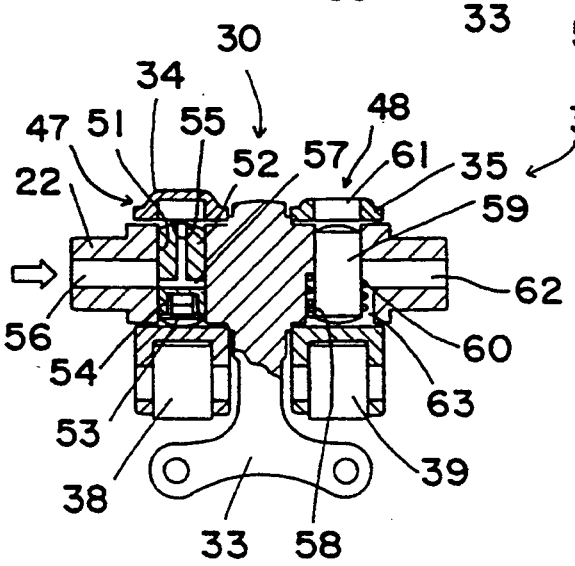
FIG. 11 (c)

MULTI-CYLINDER INTERNAL COMBUSTION ENGINE

BACKGROUND OF THE INVENTION

This invention relates to a multi-cylinder internal combustion engine for controlling operation and the like of an intake valve and an exhaust valve disposed in an automobile engine and the like.

In general, in open/close control of an intake valve and an exhaust valve of an automobile engine, the open/close timing is set according to the operation condition obtained from an engine rotation speed, the amount of depression of an accelerator pedal, and the like. In such a valve-moving apparatus, there is proposed one which varies a cam profile according to the operating condition to improve the fuel consumption at a low speed and improve volumetric efficiency into the cylinder at a high speed. This is achieved by varying the open/close timing, lift amount, release time, and the like of the intake and exhaust valves at a low or a high speed.

Specifically, the automobile engine is provided with a high-speed cam and a low-speed cam, the high-speed cam having a cam profile which is able to obtain a valve open/close timing for high-speed operation, and on the other hand, the low-speed cam having a cam profile which is able to obtain a valve open/close timing for low-speed operation. During operation of the engine, the high-speed cam or the low-speed cam can be selectively used according to the operating condition to obtain an optimum open/close timing of the intake and exhaust valves.

Further, in such an automobile engine, there has been previously proposed a cylinder-closing mechanism which stops operation of two of four cylinders of a 4-cylinder engine to improve the fuel consumption. That is, in the valve-moving apparatus, during idle operation or low-load operations, the piston is operating but operation of the intake and exhaust valves is stopped to discontinue supply of fuel.

This cylinder-closing mechanism for stopping operation of the intake and exhaust valves is generally operated by providing a change-over mechanism in the rocker arm and hydraulically controlling the change-over mechanism. In this case, hydraulic pressure is supplied from a main oil pump of the engine to the change-over mechanism through an oil passage. However, a sufficiently high hydraulic pressure cannot be obtained from the main oil pump of the engine, for operating the change-over mechanism. Specifically, as shown in FIG. 13, there is a minimum required change-over hydraulic pressure necessary for operating the change-over mechanism, with the hydraulic pressure from the main oil pump of the engine being below the required change-over hydraulic pressure. Therefore, an assist pump is provided separately from the main oil pump of the engine to obtain a hydraulic pressure higher than the required hydraulic pressure.

FIG. 18 is a schematic plan view of a cylinder head showing the valve-moving apparatus for an engine having a prior art cylinder-closing mechanism, and FIG. 19 is a schematic view showing hydraulic pressure passages of the valve-moving apparatus.

As shown in FIGS. 18 and 19, a cam shaft 202 is mounted on a cylinder head 201 at its center, and a cam (not shown at a predetermined position) is integrally formed. A pair of rocker shafts 203 are also rotatably mounted to the cylinder head parallel to the cam shaft 202. Bases of a rocker arm 204 and a rocker arm 206 having a change-over mechanism 205 are individually mounted to the rocker shafts 203, and rocking ends of the individual rocker arms 204 and 206 are opposing top ends of intake or exhaust valve 207. An oil pump 208, an accumulator 209, and an oil control valve 210 are mounted at an end of the cylinder head 201. The oil pump 208 can be driven by a driving cam 211 mounted to one end of the cam shaft 202. The oil control valve 210 can be operated by a control signal from a control unit 212.

When the cam shaft 202 rotates, the rocker arm 204 and the rocker arm 206 are rocked by the cam to drive the intake and exhaust valves. Two of the four cylinders are unworked during idle operation or low-load operation of the engine. Specifically, the oil pump 208 is driven by the driving cam 211 of the cam shaft 202, and hydraulic pressure is stored in the accumulator 209. The control unit 212 judges operational condition of the engine according to signals from various sensors, and outputs a control signal to the oil control valve 210 to change over the valve. Then, hydraulic pressure is sent to the change-over mechanism 205 of the rocker arm 206, and operation of the corresponding intake and exhaust valves 207 is stopped. Therefore, the engine is operated merely by driving of the intake and exhaust valves 207 corresponding to the rocker arm 204.

In the above-described prior art valve-moving apparatus for an engine, some rocker arms 206 are provided with change-over mechanisms 205 to stop operation of two of the four cylinders during idle operation or low-load operation. For this purpose, the oil pump 208 or the accumulator 209 is required, and these must be mounted on the cylinder head 201. In the past, as described above, these devices have been provided on the top of one end of the cylinder head 201, but this causes part of the engine to protrude upward. And, a cylinder head cover which covers the upper portion of the cylinder head 201 must be formed so that part of it to be protruded upward accordingly, resulting in an increased height of the engine. This results in an increase in engine size, and difficulty in layout when the engine is mounted in a vehicle.

With a view to solving such problems, it is a primary object of the present invention to provide a multi-cylinder internal combustion engine which enables a compact internal combustion engine.

SUMMARY OF THE INVENTION

In accordance with the present invention which attains the above object, there is provided a multi-cylinder internal combustion engine having a plurality of cylinder bores disposed in series and in a plurality of rows with phase differences between cylinders, comprising:

- a cylinder head disposed on top of a cylinder block;
- cam shafts provided a plurality of cams and disposed on the cylinder head along an axial direction of a crank shaft according to the plurality of cylinder rows;
- a first valve driving member in sliding contact with one of the cams
- a second valve driving member in contact against an engine valve;

change-over mechanism means for selectively engaging the first and second valve driving members; and hydraulic pressure supply means for hydraulically operating the change-over mechanism means according to the operating condition of the engine;

the hydraulic pressure supply means being disposed in a space part made by expanding part of a side wall of the cylinder head.

The space part is made by expanding part of a side wall in a longitudinal direction of the cylinder head.

The plurality of cams include a low-speed cam adapted for low-speed operation of the internal combustion engine and a high-speed cam adapted for high-speed operation.

The first valve driving member comprises:

a low-speed rocker arm rotatably mounted on the rocker shaft part and rocked by the low-speed cam; and a high-speed rocker arm rotatably mounted on the rocker shaft part and rocked by the high-speed cam; and the second valve driving member comprises a lever member formed from a rocker shaft part disposed adjacent to the cam shaft and rotatably mounted on a support member, and an arm part integrally formed on the rocker shaft part and contacting against the engine valve.

The hydraulic pressure supply means comprises an oil pump, an accumulator supplied with hydraulic pressure from the oil pump, and hydraulic pressure change-over means supplied with hydraulic pressure from the accumulator for changing over hydraulic pressure supply timing.

The oil pump comprises a sub-oil pump disposed downstream of an oil passage flowing from a main oil pump.

The oil pump supplies hydraulic pressure to the change-over mechanism means disposed between the low-speed rocker arm and the lever member; and the main oil pump supplies hydraulic pressure to the change-over mechanism means disposed between the high-speed rocker arm and the lever member.

Both rocker arms are rotatably mounted individually on the rocker shaft parts, one on each side of the arm part.

The low-speed rocker arm and the high-speed rocker arm are driven individually by the low-speed cam and the high-speed cam, and provided with roller bearing means rotatably mounted individually on the low-speed rocker arm and the high-speed rocker arm.

Within the space part is disposed a driving member mounted on one end of the cam shaft and driven by the crank shaft; and at least one of a first space part formed between the driving member of one cylinder row and one end of the cylinder bore of the driving member; and a second space part formed in the vicinity of the other end of the cylinder bore opposite to the driving member of the other cylinder row.

BRIEF DESCRIPTION OF THE DRAWINGS

FIGS. 11(*a*), (*b*) and (*c*) are schematic views for explaining operation of a change-over mechanism.

DESCRIPTION OF THE PREFERRED EMBODIMENTS

The multi-cylinder internal combustion engine of the present embodiment is a V-type 6-cylinder engine having two rows of cylinders disposed in V-shape at predetermined angles relative to the crank shaft, which is of a double overhead cam shaft (DOHC) type having two cam shafts for each cylinder, with two intake valves and two exhaust valves.

Figure 1:
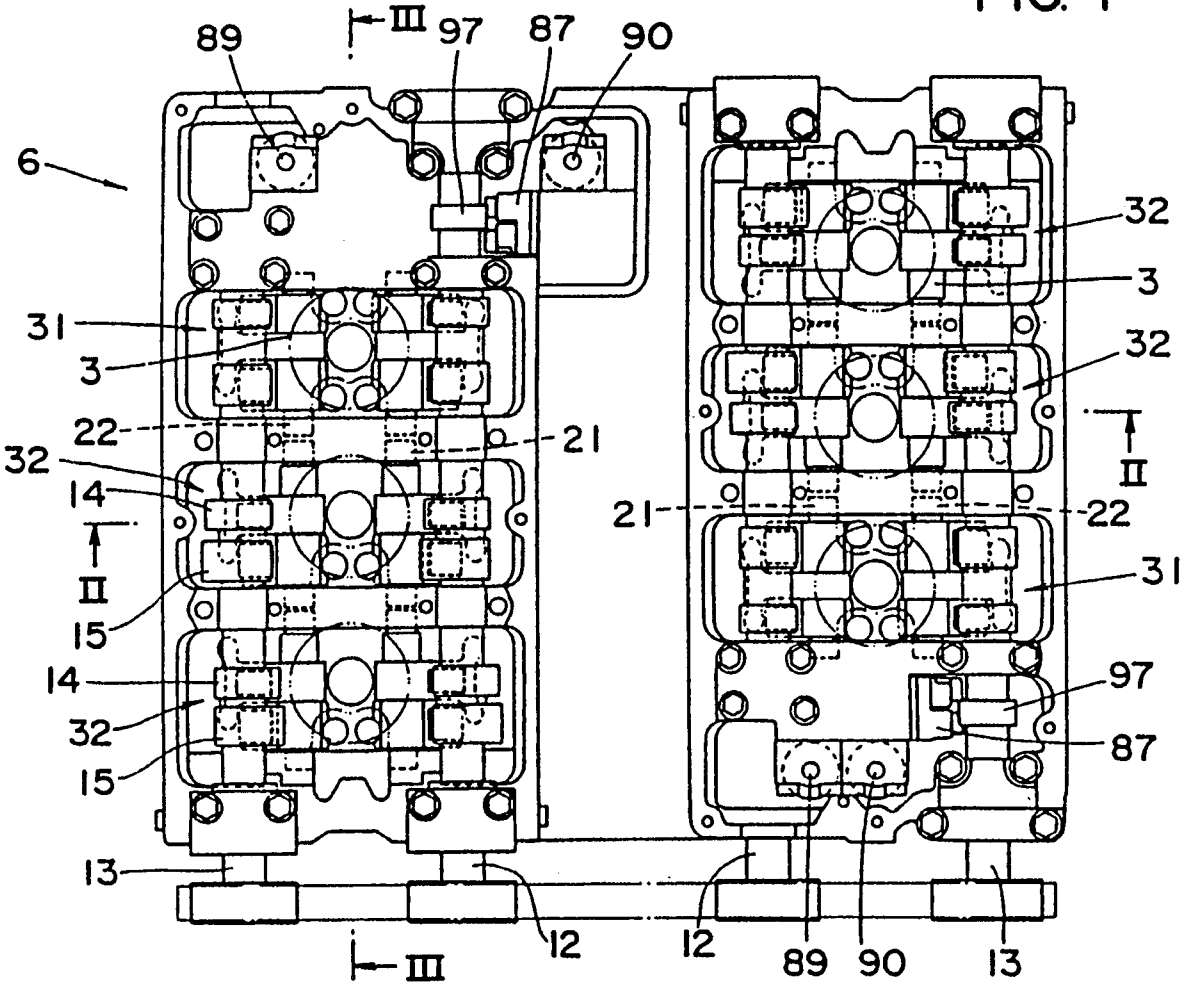
FIG. 1 is a schematic plan view of a cylinder head showing an embodiment of the valve-moving apparatus for an internal combustion engine according to the present invention.
Figure 2:
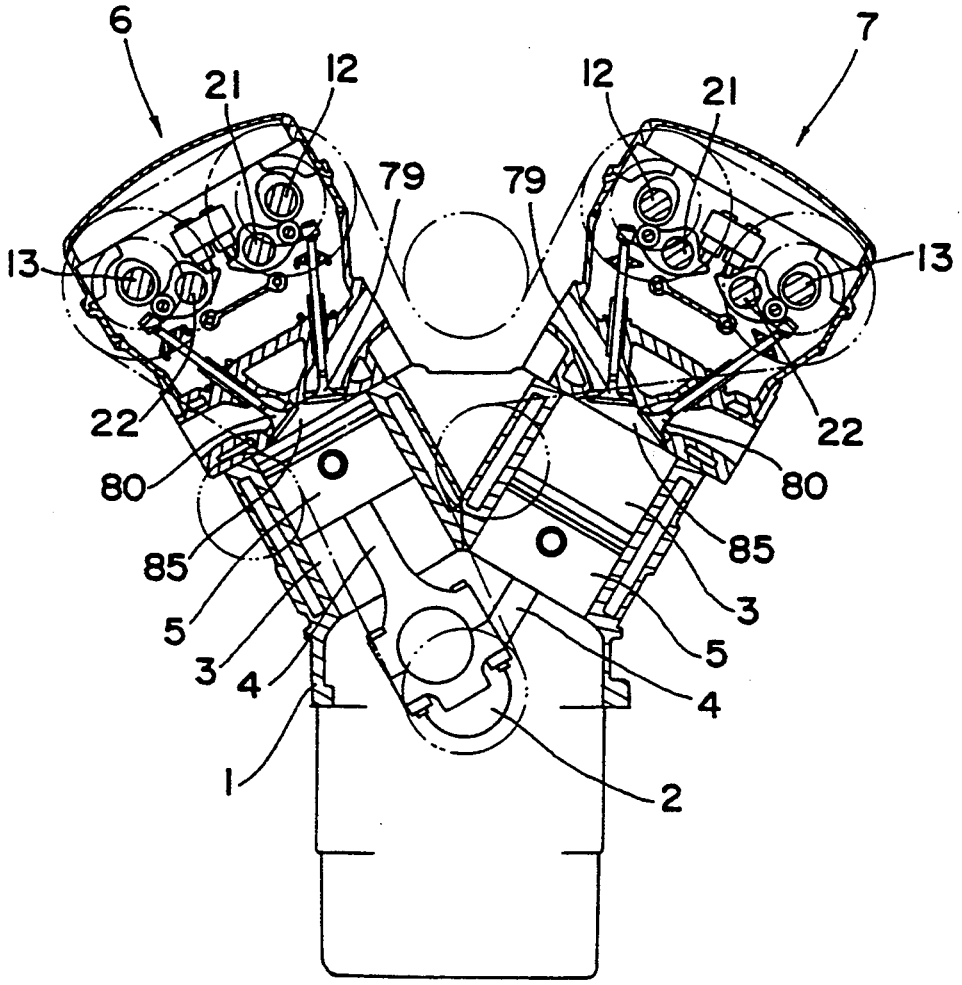
FIG. 2 is a schematic II—II cross sectional view of FIG. 1.

As shown in FIG. 1 and FIG. 2, a crank shaft 2 is rotatably supported on a cylinder block 1. Two rows, of three cylinders each, of cylinders 3 are disposed in V shape at predetermined angles relative to the crank shaft 2, with spaces being formed between cylinders 3 of each row. In this case, the two rows of cylinders 3 are formed offset in the axial direction of the crank shaft 2. The crank shaft 2 is connected with pistons 5 through connecting rods 4, and the pistons 5 are movably inserted in the individual cylinders 3. Valve-moving mechanisms 6 and 7 are provided above the two rows of individual cylinders 3. Since the valve-moving mechanisms 6 and 7 have almost the same structures, one of which will be described below. As described above, the individual cylinders 3 are inclined mutually at predetermined angles relative to the crank shaft 2. However, for simplicity, they are shown in upright positions in the drawings.

As shown in FIGS. 2 and 5 to 7, a cylinder head 11 is provided with a pair of intake cam shafts 12 and exhaust cam shafts 13 disposed above the cylinder 3 parallel to each other along a longitudinal direction, with a low-speed cam 14 having a small lift amount and a high-speed cam 15 having a large lift amount being integrally formed thereon for each cylinder. The pair of cam shafts 12 and 13 are sandwiched between an upper portion of a cam shaft housing 16 and a plurality of cam caps 17 and mounted by bolts 18 and 19 on top of the cylinder head 11, thus being rotatably supported on the cylinder head 11.

Furthermore, in the cylinder head 11 for each cylinder, a pair of intake rocker shaft part 21 and exhaust rocker shaft part 22 are disposed parallel to each other along the longitudinal direction and parallel to the pair of cam shafts 12 and 13. The pair of rocker shaft parts 21 and 22 are sandwiched between a lower portion of the cam shaft housing 16 and a plurality of cam caps 23 and mounted by bolts 19 and 24 on a lower portion of the cylinder head 11, thus being rotatably supported on the cylinder head 11. A cylinder head cover 25 is mounted on top of the cylinder head 11.

Each of the rocker shaft parts 21 and 22 is provided with a valve-moving apparatus which can be changed over to a valve open/close timing for high-speed operation and a valve open/close timing for low-speed operation, and a valve-moving apparatus which can be changed over to a high-speed valve timing and a low-speed valve timing and can be stopped operating during low-load operation. Thus, as shown in FIG. 1, of the six cylinders, valve-moving apparatus 31 of two cylinders have cylinder-closing mechanisms, and valve-moving apparatus 32 of the remaining four cylinders have no cylinder-closing mechanisms.

Figure 8:
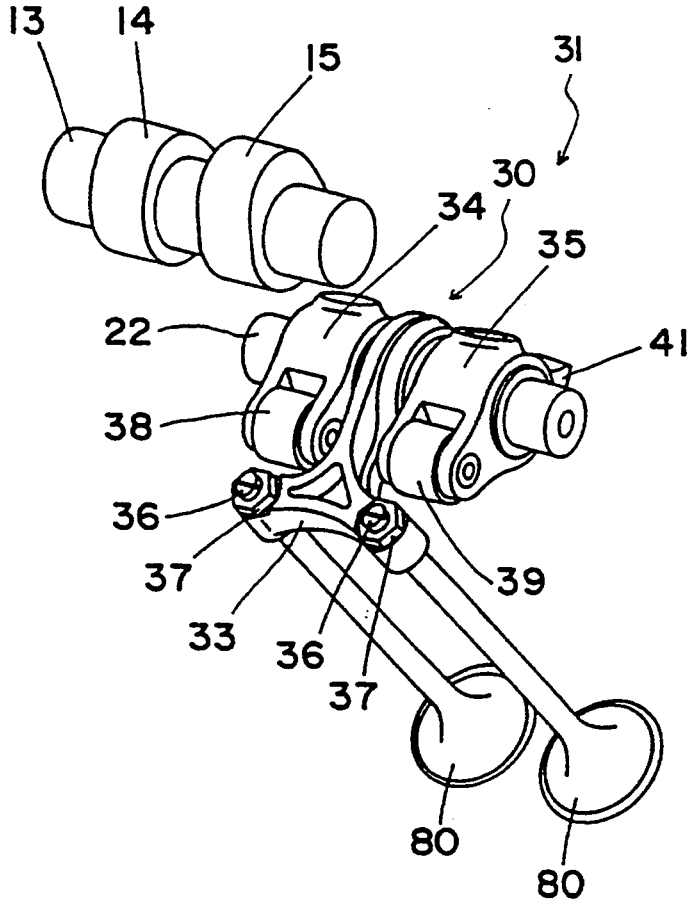
FIG. 8 is a schematic exploded perspective view of the valve-moving apparatus.

The valve-moving apparatus 31 with the cylinder-closing mechanism will now be described. As shown in FIG. 8, a T-formed lever 30 is integrally formed with a base of an arm part 33, which is nearly T-shaped in plan view at the center of the exhaust rocker shaft part 22, and a low-speed rocker arm 34 and a high-speed rocker arm 35 as sub-rocker arms disposed on both sides of the exhaust rocker shaft part 22. An adjust screw 36 is mounted to the rocking end of the arm part 33 by an adjust nut 37, and the bottom end of the adjust screw 36 is in contact against the top end of an exhaust valve 80, which will be described later.

On the other hand, the low-speed rocker arm 34, with its base attached to the rocker shaft part 22, is rotatably supported, a roller bearing 38 being mounted to its rocking end, the roller bearing 38 being capable of engaging with the low-speed cam 14. Similarly, the high-speed rocker arm 35, with its base attached to the rocker shaft part 22, is rotatably supported, a roller bearing 39 being mounted to its rocking end, the roller bearing 39 being capable of engaging with the high-speed cam 15.

Figure 7:
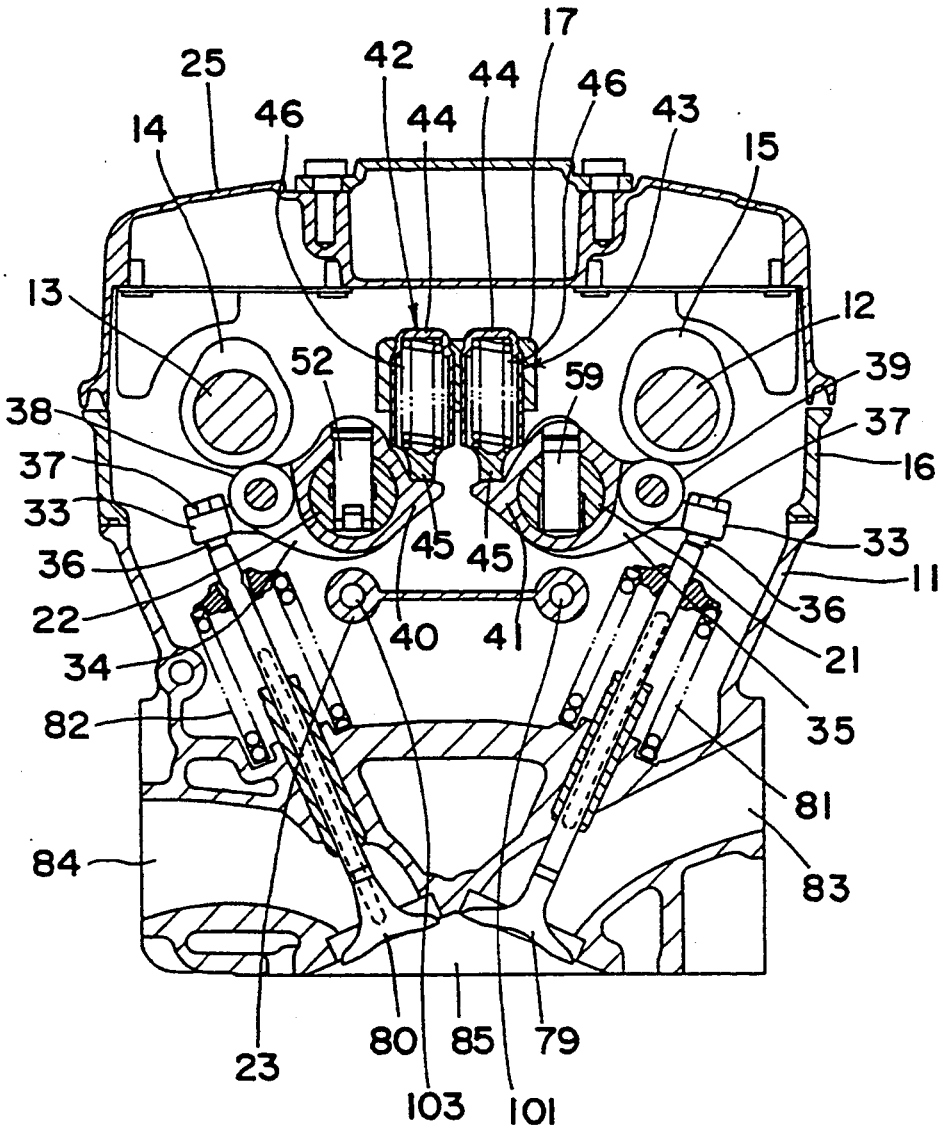
FIG. 7 is a schematic VII—VII cross sectional view of FIG. 5.

Furthermore, as shown in FIG. 7, the low-speed rocker arm 34 and the high-speed rocker arm 35 are formed with arm parts 40 and 41, respectively, at the opposite side to the rocking end to which the roller bearings 38 and 39 are mounted, the arm parts 40 and 41 being urged by the arm springs 42 and 43, respectively. The arm springs 42 and 43 comprise cylinders 44 and plungers 45 fixed to the cap 17, and compression springs 46, free ends of the plungers 45 pressing the arm parts 40 and 41 to bias the individual rocker arms 34 and 35 at the left side in FIG. 7 clockwise, and the individual rocker arms 34 and 35 at the right side counter-clockwise.

Therefore, usually, in the low-speed rocker arm 34 and the high-speed rocker arm 35, the roller bearings 38 and 39 contact against the outer peripheral surfaces of the low-speed cam 14 and the high-speed cam 15 of the cam shafts due to the arm springs 42 and 43. When the cam shafts 12 and 13 rotate, the individual cams 14 and 15 can operate to rock the low-speed rocker arm 34 and the high-speed rocker arm 35.

Figure 9:
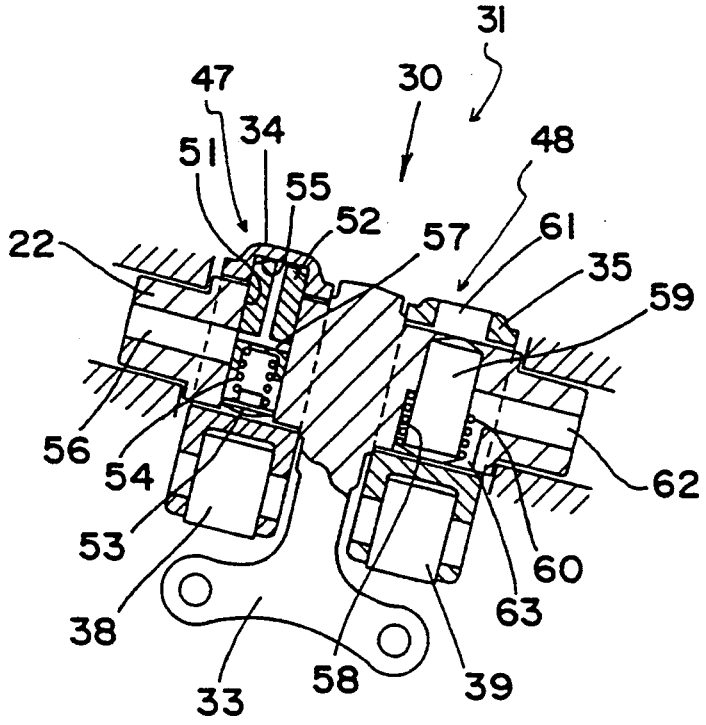
FIG. 9 is a schematic cross sectional view showing a change-over mechanism of the valve-moving apparatus.

As shown in FIG. 9, the low-speed rocker arm 34 and the high-speed rocker arm 35 can be integrally rotated with the rocker shaft part 22 by change-over mechanisms 47 and 48 as a fluid request part. Describing the change-over mechanisms 47 and 48, the rocker shaft part 22 is formed along its radial direction with a through-hole 51 at a position corresponding to the low-speed rocker arm 34. A rock pin 52 is movably inserted into the through-hole 51, and urged in one direction by a compression spring 51 supported by a spring seat 53. On the other hand, the low-speed rocker arm 34 is formed with an engaging hole 55 at a position corresponding to the through-hole 51 of the rocker shaft part 22, the engaging hole 55 being engaged with a rock pin 52 urged by a compression spring 54. The rocker shaft 22 is formed along its axial direction with a hydraulic pressure passage 56 as part of the fluid request part communicating with the through-hole 51. The rock pin 52 is formed with an oil passage 57 which communicates with the through-hole 51 and opens to the side engaging with the engaging hole 55.

Furthermore, describing the change-over mechanism 48, the rocker shaft part 22 is formed along its radial direction with a through-hole 58 at a position corresponding to the high-speed rocker arm 35. A rock pin 59 is movably inserted in the through-hole 58, and is urged in one direction by a compression spring 60. On the other hand, the high-speed rocker arm 35 is formed with an engaging hole 61 at a position corresponding to the through-hole 58 of the rocker shaft part 22. The rock pin 59 is disengaged from the engaging hole 61 by the compression spring 60. The rocker shaft part 22 is formed along its axial direction with a hydraulic pressure passage 62 communicating with the though-hole 58, and with an oil passage 63 communicating with an end opposing the engaging hole 61 of the through-hole 58.

Normally, as shown in FIG. 11(*a*), the low-speed rocker arm 34 becomes integral with the rocker shaft part 22 by engaging the rock pin 52 urged by the compression spring 54 with the engaging hole 55, and can be rotated with the arm part 33 through the rocker shaft part 22. On the other hand, in the high-speed rocker arm 35, the rock pin 59 urged by the compression spring 60 is disengaged from the engaging hole 61, and engagement with the rocker shaft part 22 is released so as not to rotate integrally with the rocker shaft part 22. Therefore, the low-speed cam 14 and the high-speed cam 15 rock the low-speed rocker arm 34 and the high-speed rocker arm 35, but only the driving force transmitted to the low-speed rocker arm 34 is transmitted to the arm part 33 through the rocker shaft part 22 to rock the T-formed lever 30.

When hydraulic pressure is supplied to the individual hydraulic pressure passages 56 and 62 of the rocket shaft part 22, as shown in FIG. 11(*b*), in the low-speed rocker arm 34, hydraulic oil flows to the engaging hole 55 side of the through-hole 51 through the oil passage 57, causing the rock pin 52 to disengage from the engaging hole 55 against the biasing force of the compression spring 54. As a result, the low-speed rocker arm 34 is disengaged from the rocker shaft part 22 not to rotate integrally therewith. On the other hand, in the high-speed rocker arm 35, hydraulic oil flows in a direction opposite to the engaging hole 61 of the through-hole 58 through the oil passage 63, causing the rock pin 59 to engage with the engaging hole 61 against the biasing force of the compression spring 60. As a result, the high-speed rocker arm 35 engages with the rocker shaft part 22 to rotate integrally therewith. Therefore, the low-speed cam 14 and the high-speed cam 15 rock the low-speed rocker arm 34 and the high-speed rocker arm 35, however, only the driving force transmitted to the high-speed rocker arm 35 is transmitted to the main rocker arm 33 through the rocker shaft part 22, thereby rocking the T-formed lever 30.

When hydraulic pressure is supplied only to the hydraulic pressure passage 56 of the rocker shaft part 22, as shown in FIG. 11(*c*), in the low-speed rocker arm 34, hydraulic oil flows to the engaging hole 55 side of the through-hole 51 to disengage the rock pin 52 from the engaging hole 55, and engagement of the low-speed rocker arm 34 with the rocker shaft part 22 is released not to rotate integrally. On the other hand, in the high-speed rocker arm 35, the rock pin 59 is disengaged from the engaging hole 61 due to the compression spring 60 to release engagement with the rocker shaft part 22, and does not rotate integrally. Therefore, the low-speed cam 14 and the high-speed cam 15 rock the low-speed rocker arm 34 and the high-speed rocker arm 35, but the driving force is not transmitted to the rocker shaft part 22, and the arm part 33 does not operate, thereby achieving a cylinder-closing condition.

Figure 12:
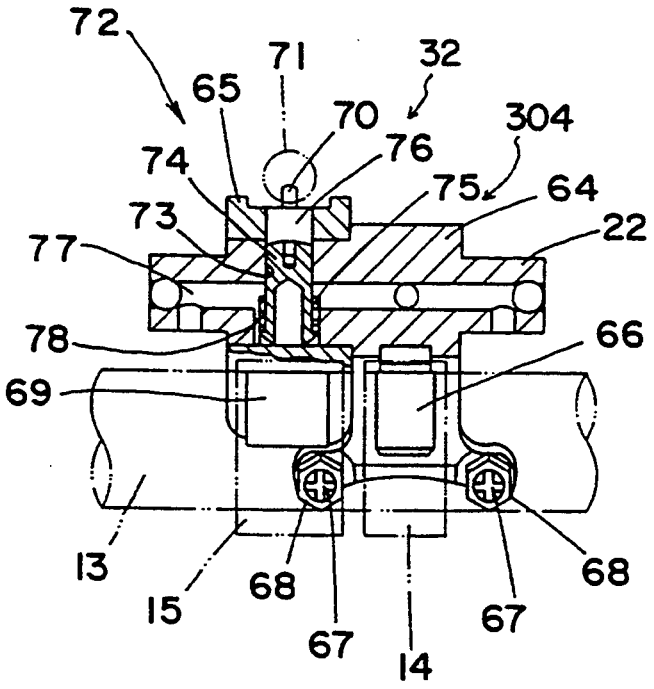
FIG. 12 is a schematic cross sectional view of the valve-moving apparatus with no cylinder-closing mechanism.
Figure 13:
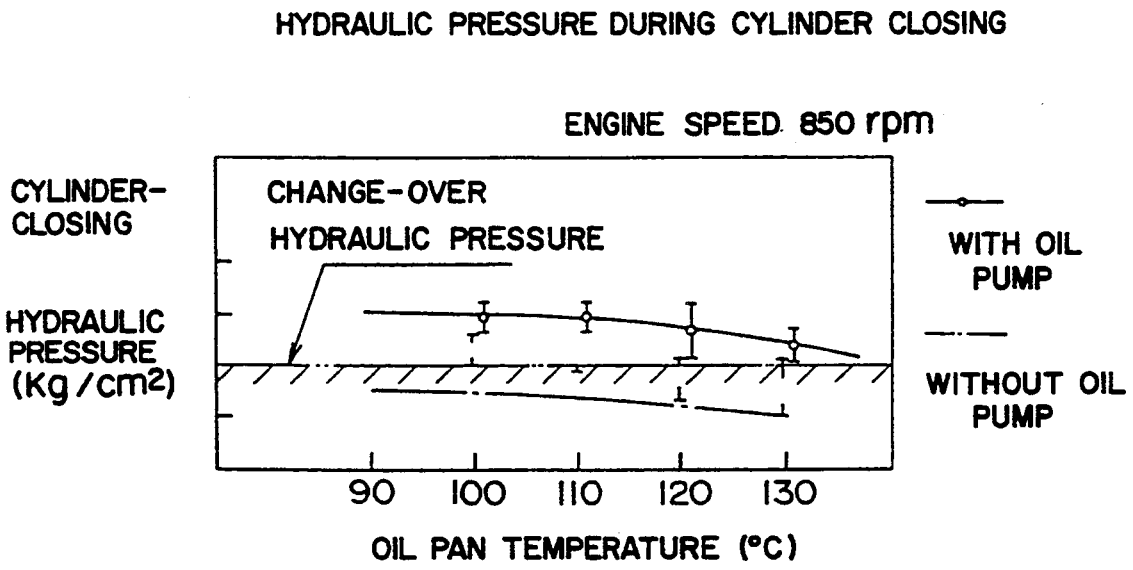
FIG. 13 is a graph showing hydraulic pressure during a cylinder-closing condition of the internal combustion engine.

In the valve-moving apparatus 32 with no cylinder-closing mechanism, as shown in FIG. 12, a T-formed lever (L) 30L is provided at an end of the exhaust rocker shaft part 22 with a low-speed arm part 64 having a T-shaped plan view and a high-speed rocker arm 65 at the other end. A roller bearing 66 is mounted to a rocking end of the low-speed arm part 64 to engage with the low-speed cam 14, an adjust screw 67 being mounted by all adjust nut 68, and a bottom end of the adjust screw 67 contacting against the top end of the exhaust valve 80.

On the other hand, the high-speed rocker arm 65 has its base mounted to the rocker shaft part 22 to be rotatably supported, with a roller bearing 69 being mounted to the rocking end, the roller bearing 69 engageable with the high-speed cam 15. The high-speed rocker arm 65 is formed with an arm part 70 at the opposite side to the rocking end to which the roller bearing 69 is mounted, and the arm part 70 is urged by an arm spring 71 to bias the high-speed rocket arm 65 in one direction. Further, the high-speed rocker arm 65 can rotate integrally with the rocker shaft part 22 by the function of a change-over mechanism 72. Specifically, the rocker shaft part 22 is formed with a through-hole 73 at a position corresponding to the high-speed rocker arm 65, a rock pin 74 being movably mounted therein, such rock pin being urged by the compression spring 75. On the other hand, the high-speed rocker arm 65 is formed with an engaging hole 76, and a rock pin is disengaged from the engaging hole 76 due to the compression spring 75. The rocker shaft part 22 is formed along its axial direction with a hydraulic pressure passage 77 communicating with the through-hole 73, and with an oil passage 78 communicating with an end opposite to the engaging hole 76 of the through-hole 73.

Normally, in the high-speed rocker arm 65, the rock pin 74 is disengaged from the engaging hole 76 due to the compression spring 75, and engagement with the rocker shaft part 22 is released not to integrally rotate with the rocker shaft part 22. Therefore, the low-speed cam 14 and the high-speed cam 15 rock the low-speed arm part 64 and the high-speed rocker arm 65, but the driving force of the low-speed cam 14 is transmitted to the exhaust valve to rock the exhaust valve 80. When hydraulic pressure is supplied to the hydraulic pressure passage 77 of the rocker shaft part 22, in the high-speed rocker arm 65, hydraulic oil flows in the opposite side to the engaging hole 76 of the through-hole 73 through the oil passage 78 causing the rock pin 74 to engage with the engaging hole 76. As a result, the high-speed rocker arm 65 and the rocker shaft part 22 engage to rotate integrally. Therefore, the high-speed cam 15 rocks the high-speed rocker arm 65, and the driving force is transmitted to the exhaust valve 80 through the rocker shaft part 22 and the low-speed arm part 64, thereby rocking the exhaust valve 80.

Only the exhaust side is described in the above description of the valve-moving apparatus 31 and 32, however, the intake side has the same structure, and merely formation positions in the peripheral direction of the cam 14 and 15 of the individual cam shafts 12 and 13 differ according to the open/close timing of the intake and exhaust valves.

As shown in FIG. 7, the intake valve 79 and the exhaust valve 80 are movably mounted on the cylinder head 11, and an intake port 83 and an exhaust port 84 are closed by valve springs 81 and 82. Therefore, the above-described arm part 33 (low-speed arm part 64) is driven to press the top ends of the intake valve 79 and the exhaust valve 80, thereby opening/closing the intake port 83 and the exhaust port 84 to communicate with a combustion chamber 85.

Figure 3:
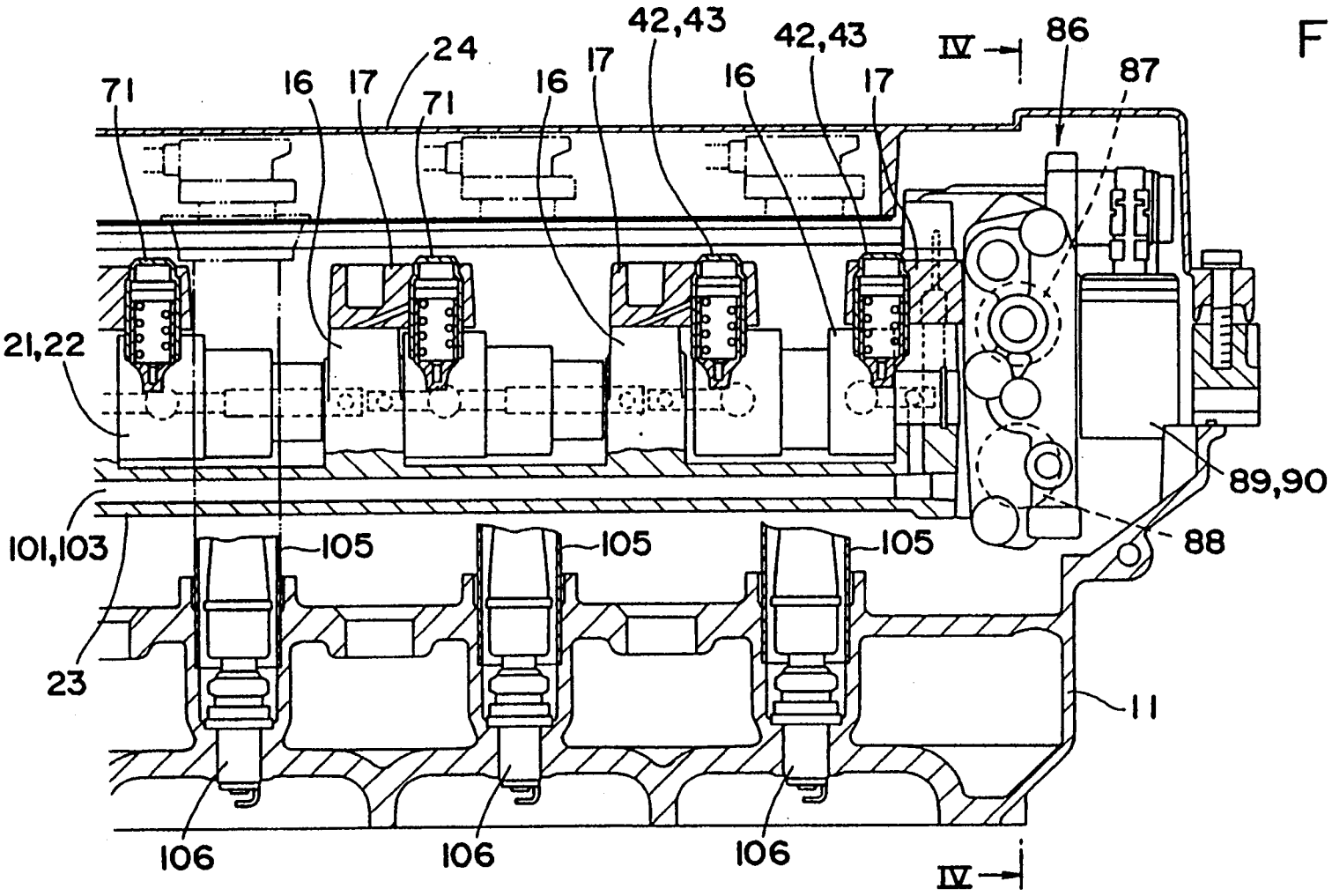
FIG. 3 is a schematic III—III cross sectional view of FIG. 1.
Figure 4:
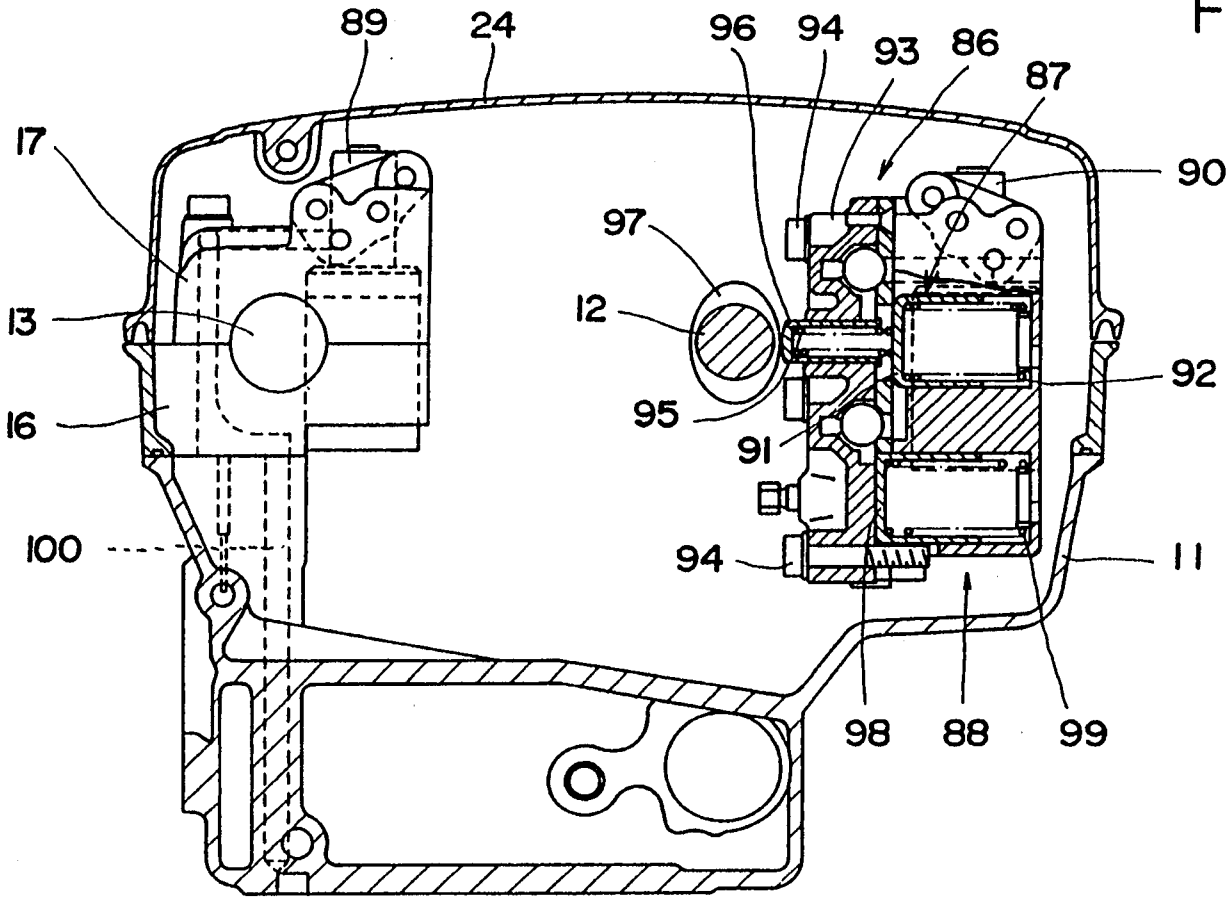
FIG. 4 is a schematic IV—IV cross sectional view of FIG. 3.
Figure 5:
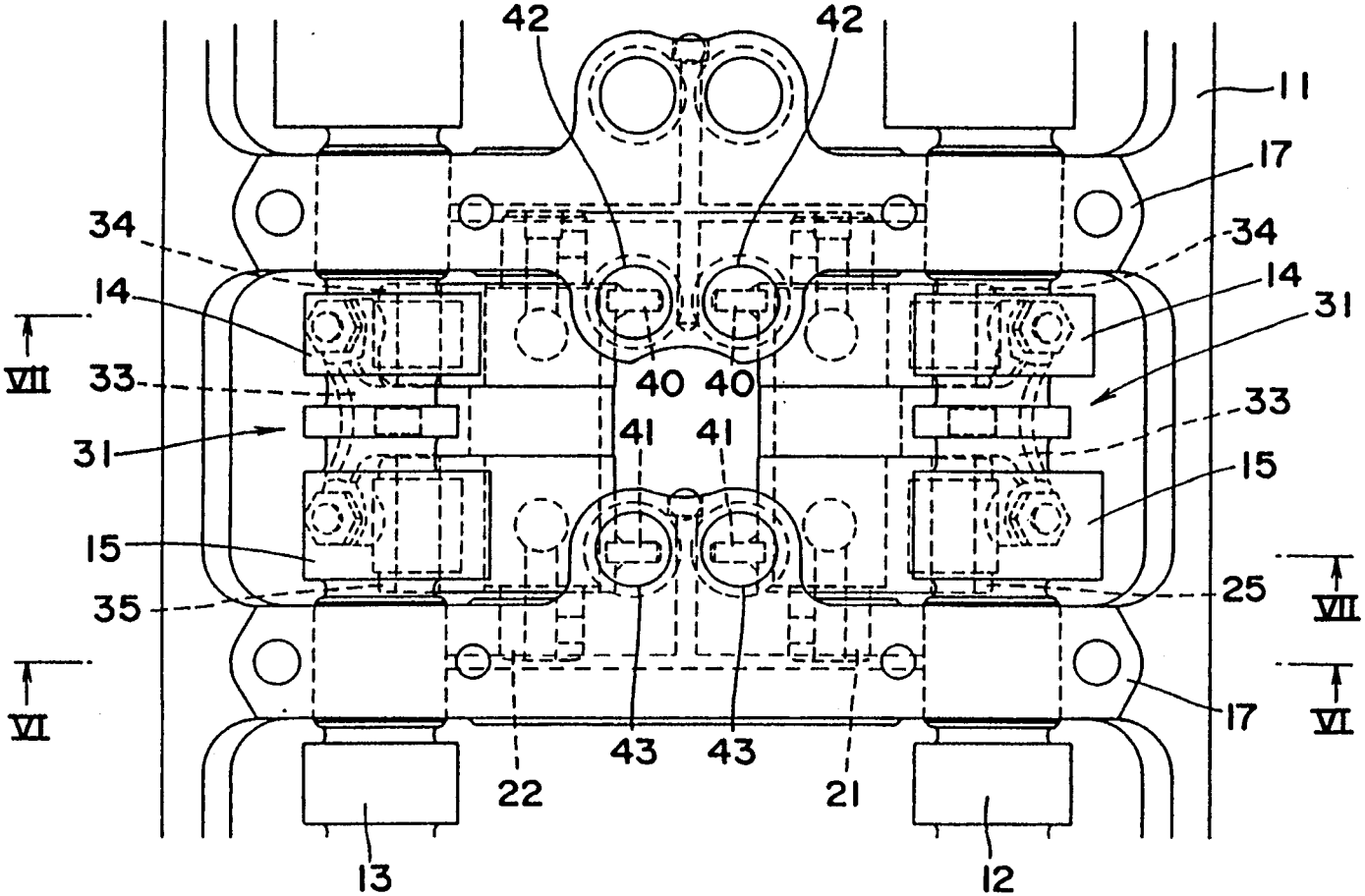
FIG. 5 is a schematic plan view of the valve-moving apparatus with a cylinder-closing mechanism.
Figure 6:
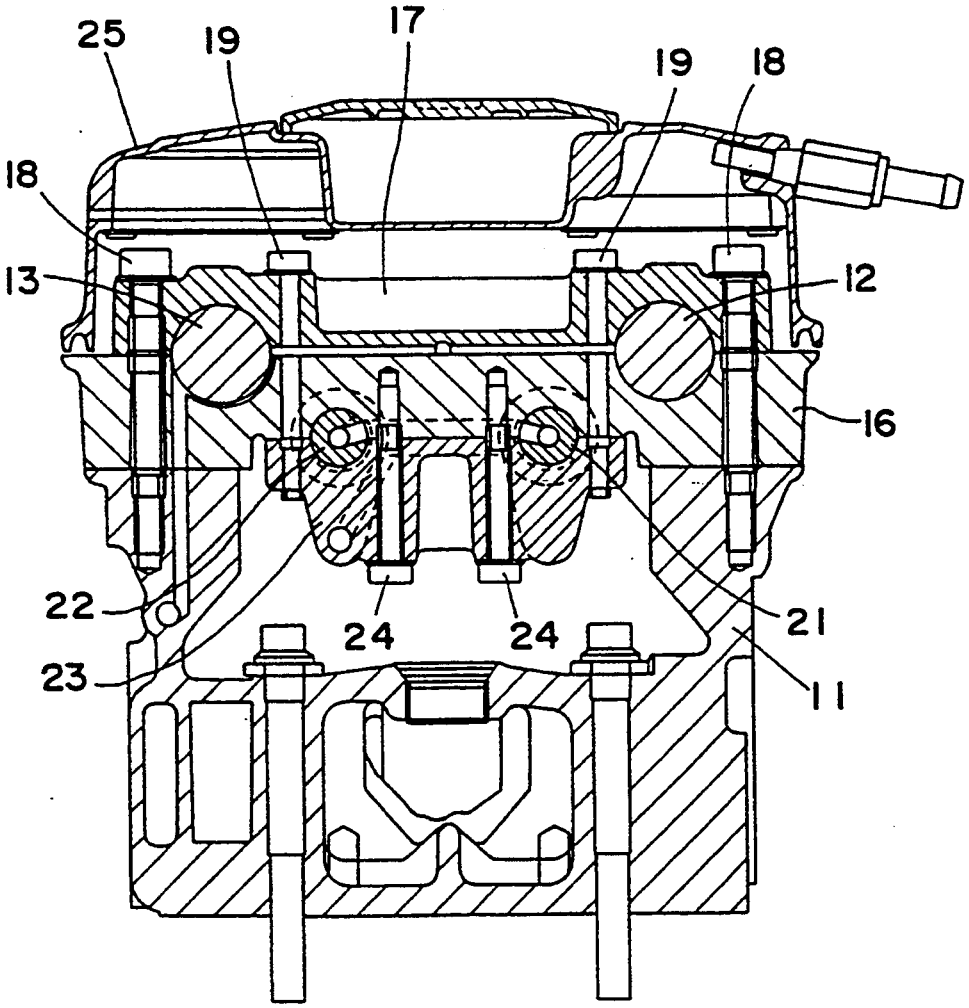
FIG. 6 is a schematic VI—VI cross sectional view of FIG. 5.

As shown in FIGS. 1, 3, and 4, in the cylinder head 11, a space is formed between the right and left rows of cylinders 3. In the present embodiment a hydraulic pressure control device 86 for operating the change-over mechanisms 47, 48, and 72 of the above-described valve-moving apparatuses 31 and 32 is provided in this space. As shown in FIGS. 3 and 4, the hydraulic pressure control device 86 comprises an oil pump 87 as an assist pump, an accumulator 88, a high-speed change-over oil control valve 89, and a cylinder-closing change-over oil control valve 90. The hydraulic pressure control devices 86 provided at axial end portions of the right and left cam shafts 12 and 13 are almost the same in structure, and only one of which is described here.

The oil pump 87 and the accumulator 88 are located in the space formed between the left and right rows of cylinders 3, both being juxtaposed vertically, with both axial centers being in the horizontal direction. Specifically, on the side of the cam cap housing 16 and the cam cap 17 at the rearmost portion of the cylinder head 11, a piston 91 of the oil pump 87 is disposed at the upper side to be movable in the horizontal direction, and fixed by bolts 94 through a cover 93. The piston 91 of the oil pump 87 is urged by a plunger 96 through a compression spring 95, and the plunger 96 can be driven by an oil pump cam 97 formed at one end of the intake cam shaft 12. The cam portions of the oil pump cam 97 are provided in a number greater than the number of cylinders to be closed. Thus, since this embodiment has two cylinders to be closed, two cam portions are provided projecting to the outside on the outer periphery of the intake cam shaft 12.

On the side of the cam cap housing 16 and the cam cap 17, a piston 98 of the accumulator 88 is supported movable in the horizontal direction and biased by a compression spring 99, and also mounted by bolts 94 through the cover 93. The piston 91 of the oil pump 87 and the piston 98 of the accumulator 88 are the same in diameters. Thus, they can be used interchangeably. The high-speed change-over oil control valve 89 and the cylinder-closing change-over oil control valve 90 are mounted on the cylinder head 11.

Figure 10:
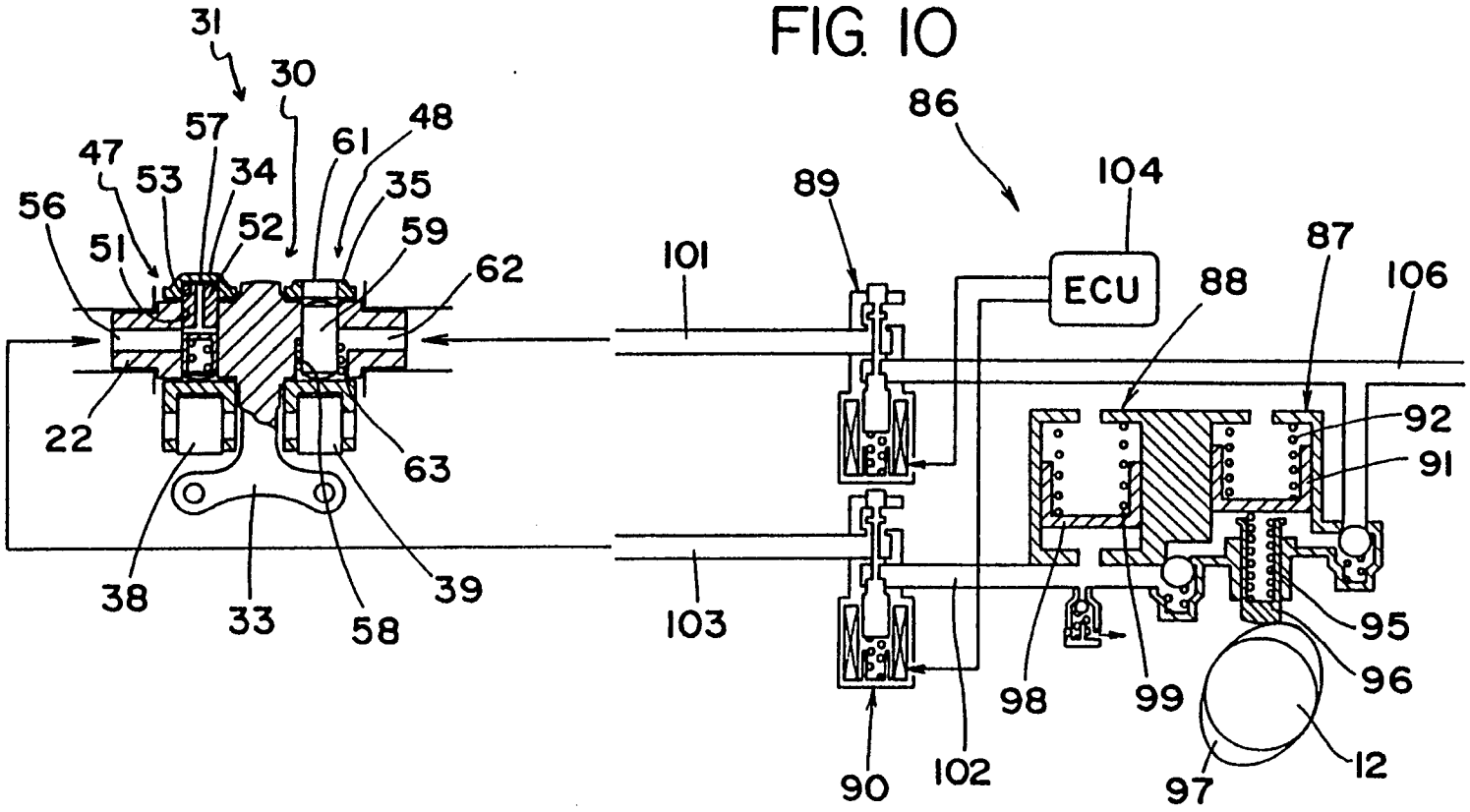
FIG. 10 is a schematic view showing hydraulic pressure passages of the valve-moving apparatus.

As shown in FIGS. 3, 4 and 10, the high-speed change-over oil control valve 89 is connected directly to the main oil pump of the engine (not shown) and to the hydraulic pressure passage 62 through an oil passage 101. The cylinder-closing change-over oil control valve 90 is connected to the accumulator 88, the oil pump 87, and the main oil pump, as well as to the hydraulic pressure passage 56 through an oil passage 103. Furthermore, the individual oil control valves 89 and 90 can be operated by control signals of an engine control unit 104.

The change-over mechanism 72 of the valve-moving apparatus 32 can also be operated by the hydraulic pressure control device 86, as for the valve-moving apparatus 31, and the hydraulic pressure passage 77 of the rocker shaft part 22 is connected with the oil control valve 89 through an oil passage (not shown). As shown in FIG. 3, the cylinder head 11 is provided with a hollow plug tube for each cylinder, an ignition plug is disposed inside each plug tube 105, and its end faces within each combustion chamber 85.

Operation of the V-type 6-cylinder engine of the present embodiment will be described. The engine control unit 104 detects operating condition of the engine from detection results of various sensors. If the engine is in a low-speed traveling condition, it selects a cam profile according to the condition. In this case, the engine control unit 104 outputs control signals to the individual oil control valves 89 and 90 to close the valves. Then, hydraulic oil is not supplied to the individual hydraulic pressure passages 56, 62, and 77, in the valve-moving apparatus 31. As shown in FIG. 11(*a*), the low-speed rocker arm 35 and the rocker shaft part 22 become integral, and engagement is released between the high-speed rocker arm 35 and the rocker shaft part 22. Therefore, when the cam shafts 12 and 13 rotate, the low-speed rocker arm 34 is rocked by the low-speed cam 14; and the driving force is transmitted to the arm part 33 through the rocker shaft part 22 to rock the T-formed lever 30, the pair of adjust screws 36 at the rocking end rock the intake valve 79 and the exhaust valve 80. On the other hand, in the valve-moving apparatus 32, as shown in FIG. 12, engagement is released between the high-speed rocker arm 65 and the rocker shaft part 22. Thus, when the cam shafts 12 and 13 rotate, the T-formed lever (L) 30L is rocked by the low-speed cam 14, and the pair of adjust screws 67 at the rocking end rock the intake valve 79 and the exhaust valve 80. Thus, the intake valve 79 and the exhaust valve 80 are driven in an open/close timing corresponding to low-speed operation, and the engine is operated at a low-speed.

When the engine control unit 104 detects a high-speed traveling condition of the engine, the engine control unit 104 outputs control signals to the individual oil control valves 89 and 90 to open the valves. Then, hydraulic oil is supplied to the individual oil passages 56, 62, and 77. During high-speed operation of the engine, in the valve-moving apparatus 31, as shown in FIG. 11(*b*), the rock pin 52 is disengaged from the engaging hole 55 by hydraulic oil to release engagement between the low-speed rocker arm 34 and the rocker shaft part 22. Further, the rock pin 59 engages with the engaging hole 61 such that the high-speed rocker arm 35 and the rocker shaft part 22 become integral. Therefore, the high-speed rocker arm 35 is rocked by the high-speed cam 15, and the T-formed lever 30 rocks to drive the intake valve 79 and the exhaust valve 80. On the other hand, in the valve-moving apparatus 32, the rock pin 74 is engaged with the engaging hole 76 by hydraulic oil supplied, and the high-speed rocker arm 65 and the rocker shaft part 22 become integral. Therefore, the T-Formed lever (L) 3OL is rocked by the high-speed cam 15 through the high-speed rocker arm 65 to drive the intake valve 79 and the exhaust valve 80. Thus, the intake valve 79 and the exhaust valve 80 are driven in an open/close timing corresponding to high-speed operation, and the engine is operated at a high speed.

When the engine control unit 104 detects an idle operation condition or a low-load operation condition of the engine, two of the six cylinders are stopped, thereby improving gas mileage. The engine control unit 104 outputs control signals to the individual oil control valves 89 and 90 to open only the valve 90. Then, hydraulic oil is supplied to the oil passage 56, and in the valve-moving apparatus 31, as shown in FIG. 11(*c*), engagement is released between the low-speed rocker arm 34 and the rocker shaft part 22. Therefore, driving force of the low-speed cam 14 and the high-speed cam 15 is not transmitted to the T-formed lever 30, and the valve-moving apparatus 31 does not operate, achieving a cylinder-closing condition. On the other hand, in the valve-moving apparatus 32, the low-speed arm part 64 is rocked by the low-speed cam 14 to drive the intake valve 79 and the exhaust valve 80. Thus, the engine is operated by driving only the intake valve 79 and the exhaust valve 80 corresponding to the valve-moving apparatus 32.

As described above, in the valve-moving apparatus of the present embodiment, since the hydraulic pressure control device 86 for operating the change-over mechanisms 47, 48, and 72 of the valve-moving apparatuses 31 and 32 comprises the oil pump 87, the accumulator 88, the individual oil control valves 89 and 90, the hydraulic pressure control devices 86 being disposed in the space formed between the right and left rows of cylinders 3, and the oil pump 87 and the accumulator 88 being vertically disposed relative to each other in the space formed between the left and right rows of cylinders 3, the oil pump 87 and the accumulator 88 can be efficiently disposed. Such an arrangement achieves a compact layout of the cylinder head 11, and prevents upward protrusion of part of the engine, namely forming a tall engine. Such space is provided by extending a section of the cylinder head 11 transversely along its longitudinal direction.

The above embodiment describes a V-type 6-cylinder internal combustion engine, however, the description may also be applied to any type of V-type multi-cylinder internal combustion engine where the two rows of cylinders are disposed mutually at predetermined angles relative to the crank shaft. Further, the hydraulic pressure control device 86 is provided in the cylinder head 11, but it may alternatively be provided externally.

As described above in detail with reference to the embodiments, with the valve-moving apparatus according to the present invention, in a multi-cylinder internal combustion engine in which two rows of cylinders are disposed mutually at predetermined angles relative to the crank shaft, since a pair of cam shafts and a pair of rocker shaft parts having the low-speed cam and the high-speed cam, mutually offset in the axial direction corresponding to the two rows of cylinders, are provided, the rocker shaft parts are integrally provided with arm parts having rocking ends facing the top ends of the intake or exhaust valve and engage with one of the low-speed cam and the high-speed cam. A low-speed rocker arm and a high-speed rocker arm engaging with the other of the low-speed cam and the high-speed cam is rotatably mounted, rock pins movable in the through-hole in the rocker shaft part for selectively engaging the low-speed rocker arm; and the high-speed rocker arm and the hydraulic pressure control device for controlling operation of the rock pins are provided. The hydraulic pressure control device is disposed in the space between the two rows of cylinders disposed mutually at predetermined angles such that the hydraulic pressure control device can be efficiently disposed so that part of the internal combustion engine does not protrude upward, the engine height does not increase, and the entire size of the internal combustion engine is unchanged, thereby achieving a compact layout of the cylinder head and a small-sized internal combustion engine.

Another embodiment of the present invention is shown in FIGS. 14 to 17. This embodiment has a valve-moving apparatus similar to that used in the previous embodiment. Members having similar functions to those used in the previous embodiment are indicated by the same symbols, and description thereof is omitted.

Figure 14:
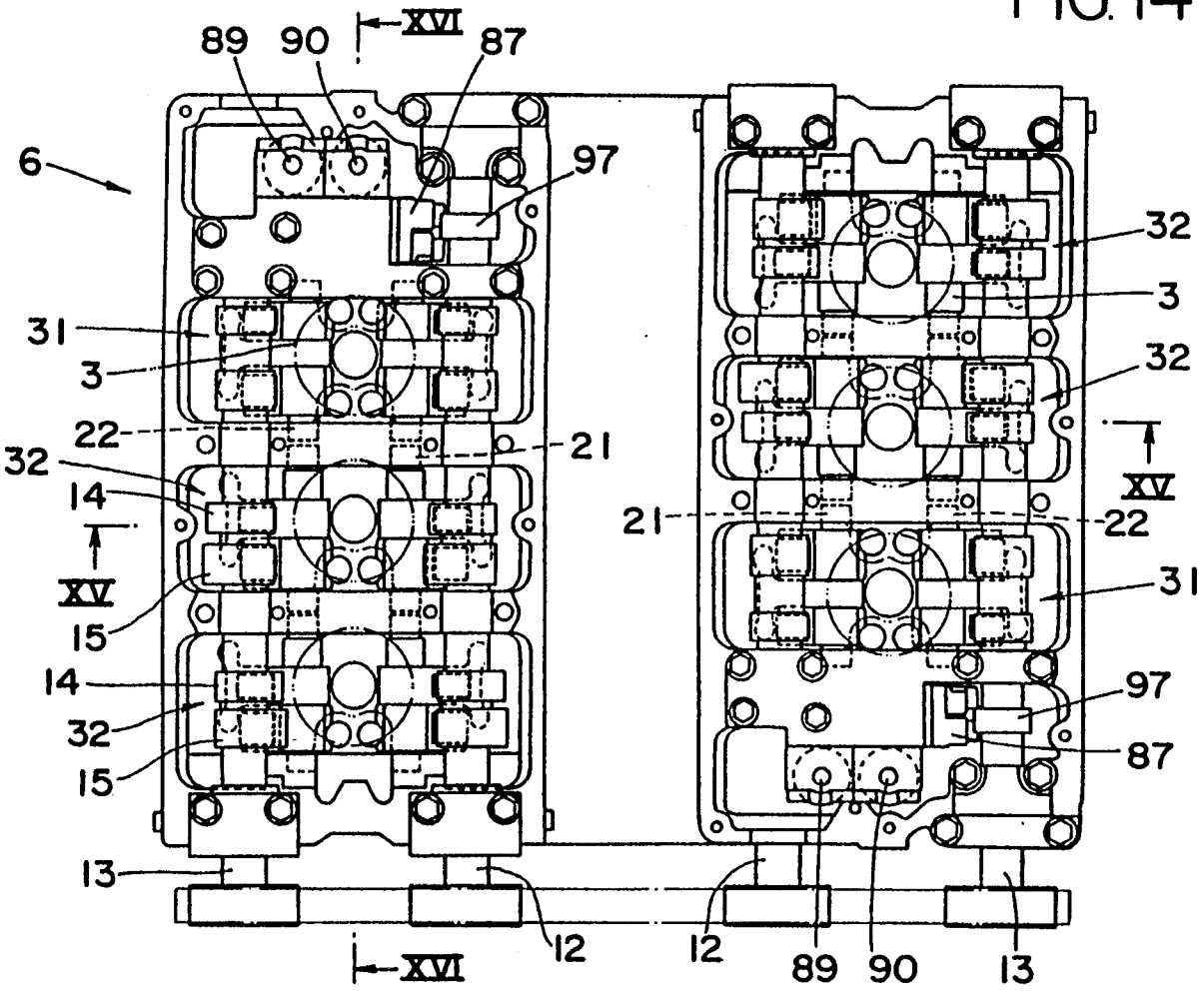
FIG. 14 is a schematic plan view of a cylinder head showing another embodiment of the valve-moving apparatus for an internal combustion engine according to the present invention.
Figure 15:
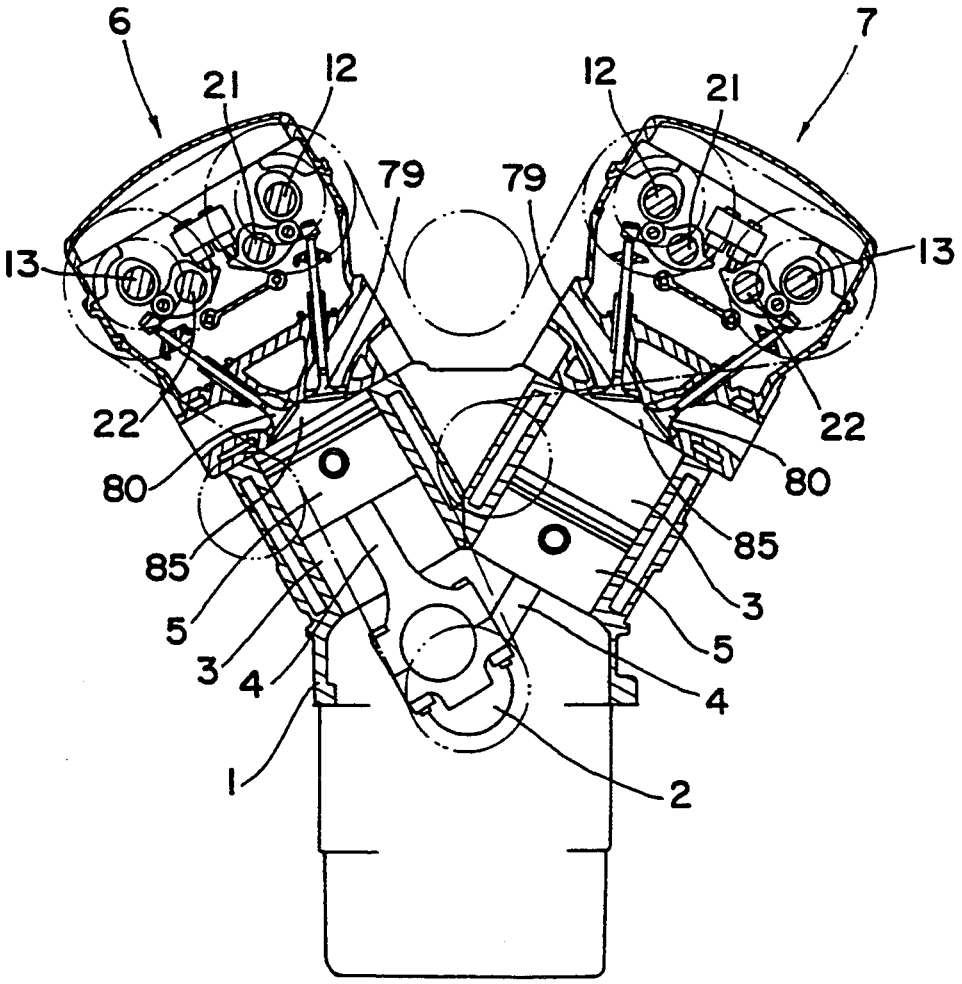
FIG. 15 is a schematic XV—XV cross sectional view of FIG. 14.
Figure 16:
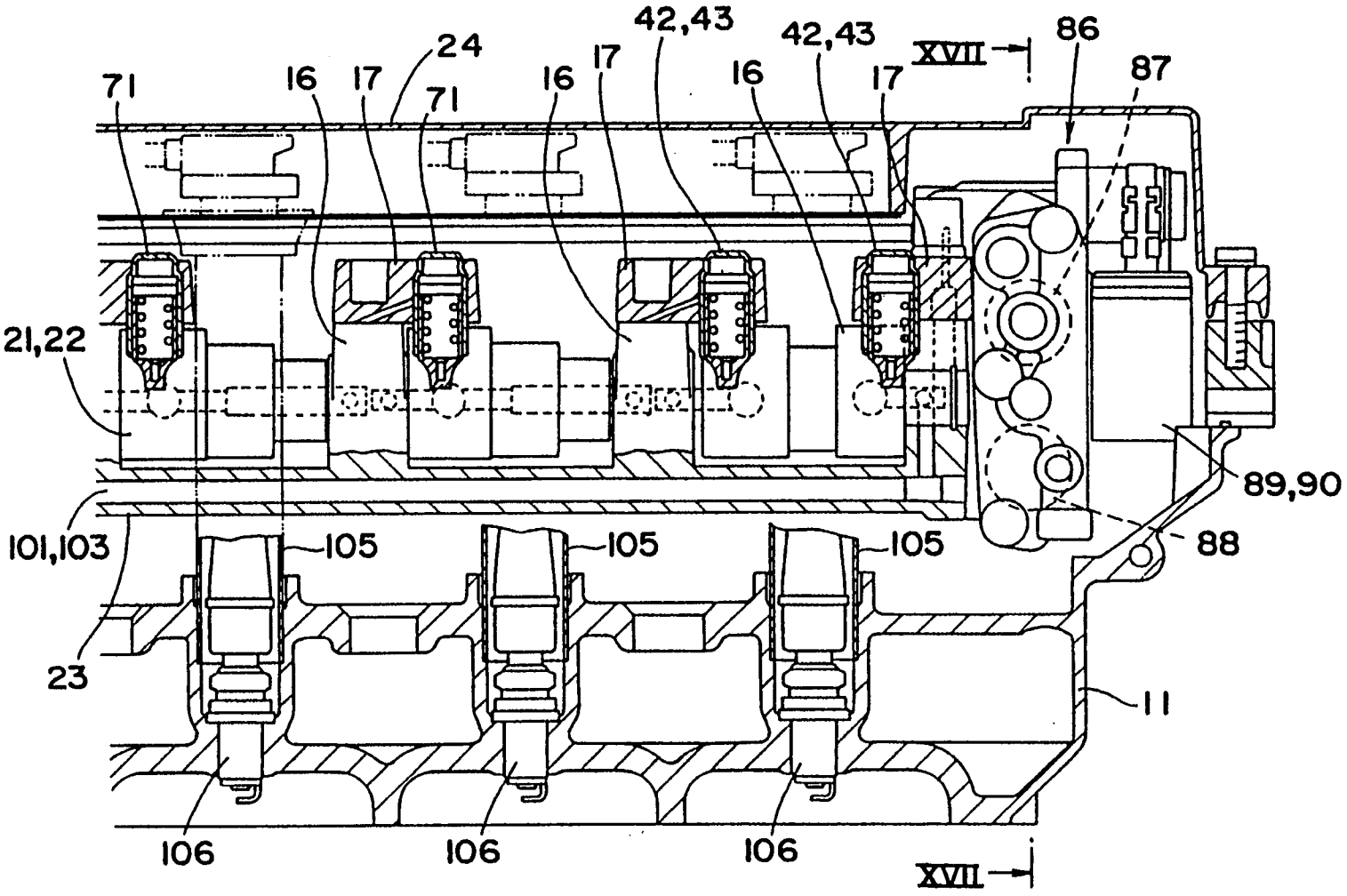
FIG. 16 is a schematic XVI—XVI cross sectional view of FIG. 14.
Figure 17:
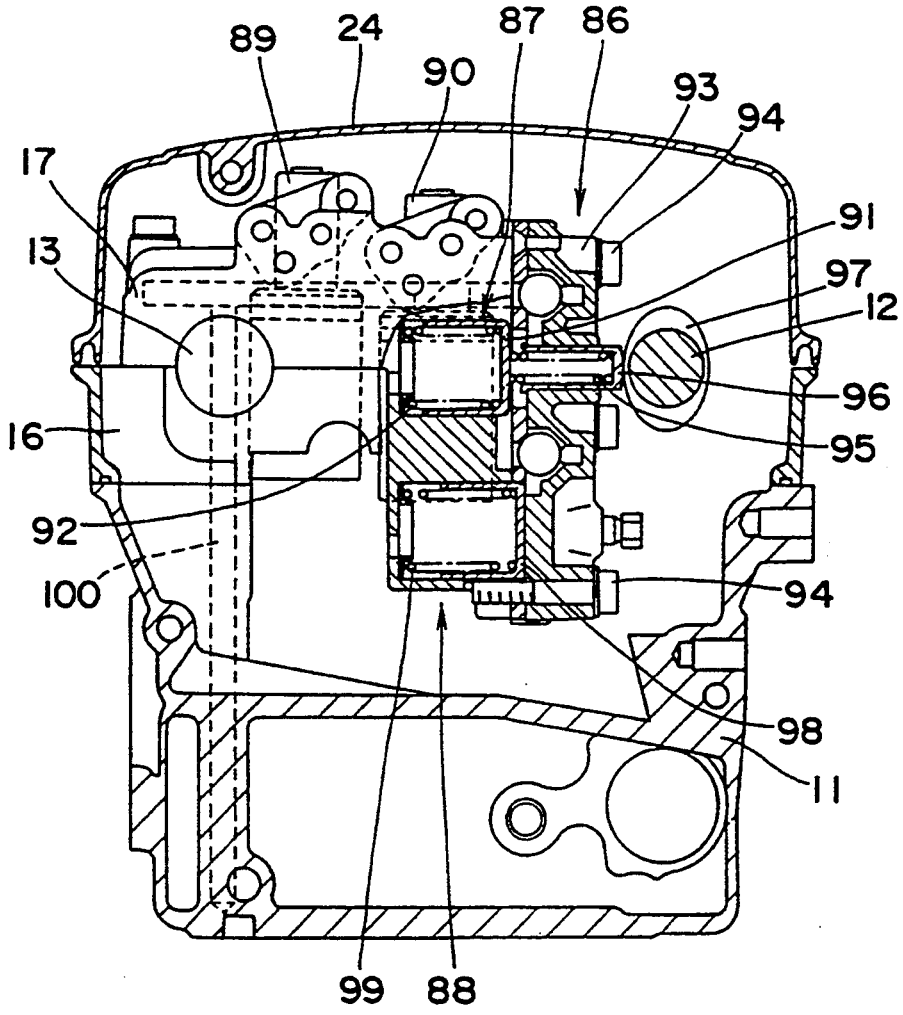
FIG. 17 is a schematic XVII—XVII cross sectional view of FIG. 16.
Figure 18:
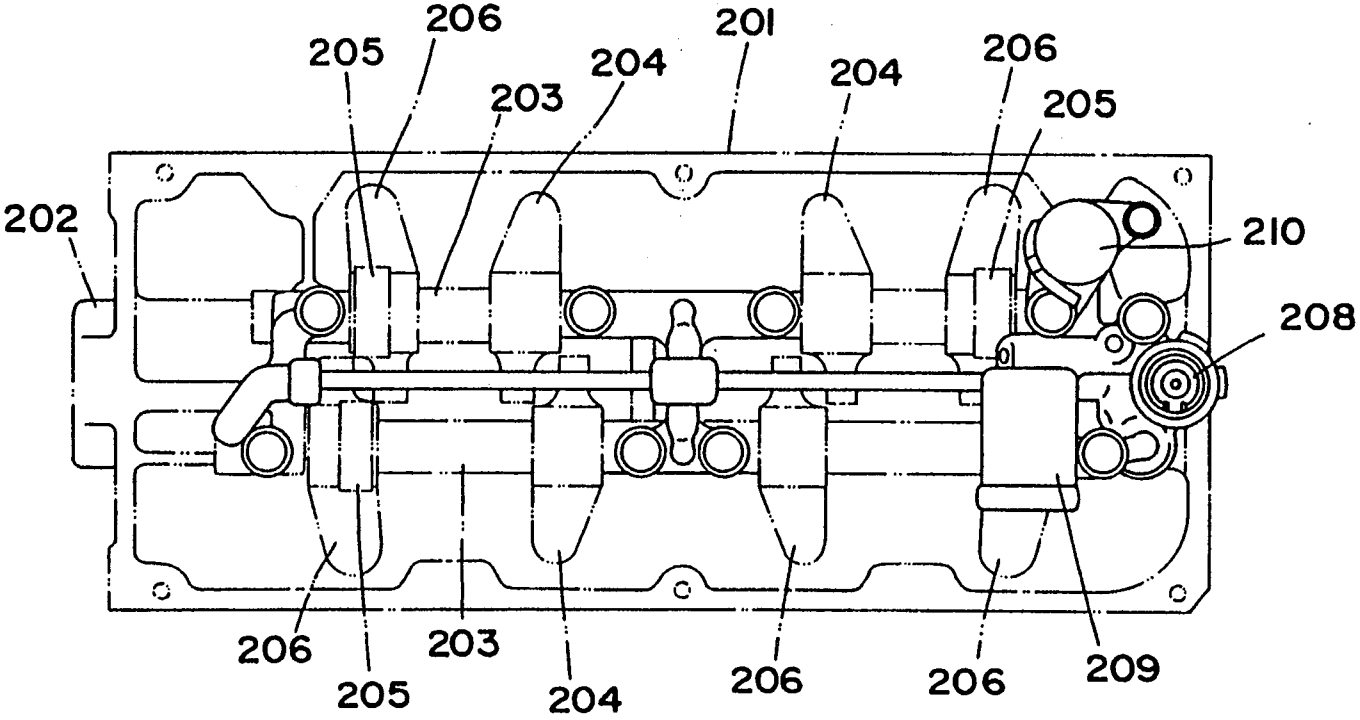
FIG. 18 PRIOR ART
FIG. 18 is a schematic plan view of a cylinder head showing the valve-moving apparatus for an engine having a prior art cylinder-closing mechanism.
Figure 19:
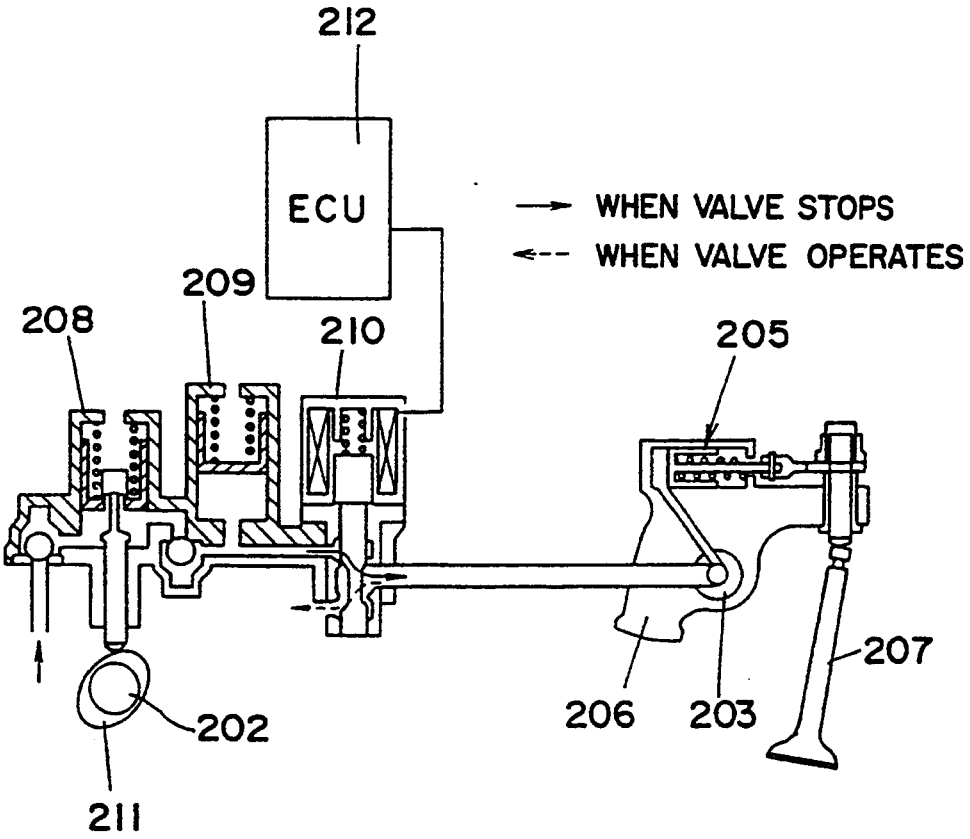
FIG.19 PRIOR ART
FIG. 19 is a schematic view showing hydraulic pressure passages of a prior art valve-moving apparatus.

As shown in FIGS. 14, 16, and 17, in the cylinder head 11, the individual cam shafts 12 and 13 are offset in the axial direction according to the right and left offset rows of the cylinders 3, thus forming a space at an axial end portion of the cam shafts 12 and 13. Therefore, in the present embodiment, a hydraulic pressure control device 86 for the above-described change-over mechanisms 30 and 72 of the valve-moving apparatus 31 and 32 are disposed in the space. The hydraulic pressure control device 86 comprises an oil pump 87, an accumulator 88, a high-speed change-over oil control valve 89, and a cylinder-closing change-over oil control valve 90. The hydraulic pressure control devices 86 provided at axial end portions of the right and left cam shafts 12 and 13 are the same in structure as those used in the previous embodiment.

In the valve-moving apparatus of the present embodiment, since the hydraulic pressure control device 86 are disposed at the axial end spaces of the individual cam shafts 12 and 13 according to the right and left offset rows of the cylinders 3, and the oil pump 87 and the accumulator 88 are vertically disposed relative to each other between the intake cam shaft 12 and the exhaust cam shaft 13, the oil pump 87 and the accumulator 88 can be efficiently disposed. Such arrangement achieves a compact layout of the cylinder head 11, and prevents upward protrusion of part of the engine, namely forming a tall engine.

The above embodiment describes a V-type 6-cylinder internal combustion engine. However, the description may also be applied to any type of V-type multi-cylinder internal combustion engine where the two rows of cylinders are disposed mutually at predetermined angles relative to the crank shaft. Further, the hydraulic pressure control device 86 is provided in the cylinder head 11, but it may alternatively be provided externally.

Alternatively, of a plurality of cylinder rows, all of the cylinders in one row may be stopped operating.

As described above, the present embodiment can also provide the same effects as the previous embodiment.

We claim:

1. A multi-cylinder internal combustion engine having a plurality of cylinder bores disposed in series and in at least two rows with phase differences between cylinders, comprising:

at least one cylinder head disposed on top of a cylinder block;

cam shafts, said cam shafts including a plurality of cams and being disposed on said at least one cylinder head along an axial direction of a crank shaft according to said plurality of cylinder rows;

a first valve driving member in sliding contact with one of said cams;

a second valve driving member in contact against an engine valve;

change-over mechanism means for selectively engaging said first and second valve driving members; and hydraulic pressure supply means for hydraulically operating said change-over mechanism means according to the operating condition of the engine, said hydraulic pressure supply means being disposed in a space formed by expanding part of a side wall in a width direction of one of said at least one cylinder head, said side wall facing toward the other of said plurality of cylinder rows.

2. The multi-cylinder internal combustion engine of claim 1 wherein said plurality of cams include a low-speed cam adapted for low-speed operation of the engine and a high-speed cam adapted for high-speed operation of the engine.

3. The multi-cylinder internal combustion engine of claim 2 wherein said first valve driving member comprises:

a low-speed rocker arm rotatably mounted on a rocker shaft part and rocked by said low-speed cam; and a high-speed rocker arm rotatably mounted on said rocker shaft part and rocked by said high-speed cam; and said second valve driving member comprises a lever member formed integrally with said rocker shaft part, said rocker shaft part being disposed adjacent to one of said cam shafts and rotatably mounted on said cylinder head, and including an arm part contacting against said engine valve.

4. The multi-cylinder internal combustion engine of claim 3 wherein said hydraulic pressure supply means comprises an oil pump assembly, an accumulator supplied with hydraulic pressure from said oil pump assembly, and hydraulic pressure change-over means supplied with hydraulic pressure from said accumulator for changing over hydraulic pressure supply timing.

5. The multi-cylinder internal combustion engine of claim 4 further comprising a main oil pump, wherein said oil pump assembly includes an assist oil pump disposed downstream of an oil passage flowing from said main oil pump.

6. The multi-cylinder internal combustion engine of claim 5 wherein said change-over mechanism means includes a first change-over mechanism means and a second change-over mechanism means;

said oil pump assembly supplies hydraulic pressure to said first change-over mechanism means disposed between said low-speed rocker arm and said lever member; and said main oil pump supplies hydraulic pressure to said second change-over mechanism means disposed between said high-speed rocker arm and said lever member.

7. The multi-cylinder internal combustion engine of claim 3 wherein said one of both said rocker arms is rotatably mounted on each side of said arm part.

8. The multi-cylinder internal combustion engine of claim 3 wherein said low-speed rocker arm and said high-speed rocker arm each include roller bearing means rotatably mounted thereon, and are driven by said low-speed cam and said high-speed cam, respectively.

* * * * *